US007975659B2

(12) United States Patent
Cerreto

(10) Patent No.: US 7,975,659 B2
(45) Date of Patent: Jul. 12, 2011

(54) CYLINDER/CRANKCASE GROUP FOR TWO-STROKE INTERNAL COMBUSTION ENGINES PROVIDED WITH MEANS FOR SUPERCHARGING THE ENGINE

(75) Inventor: Nicola Cerreto, Bagnolo In Piano (IT)

(73) Assignee: Emak S.p.A., Bagnolo In Piano (RE) (IT)

( * ) Notice: Subject to any disclaimer, the term of this patent is extended or adjusted under 35 U.S.C. 154(b) by 513 days.

(21) Appl. No.: 12/129,512

(22) Filed: May 29, 2008

(65) Prior Publication Data

US 2008/0308084 A1 Dec. 18, 2008

(30) Foreign Application Priority Data

Jun. 13, 2007 (EP) ..... 07425370

(51) Int. Cl.
*F02B 33/04* (2006.01)

(52) U.S. Cl. ..... 123/73 C; 123/73 PP

(58) Field of Classification Search ..... 123/73 C, 123/73 R, 73 A, 73 PP, 74 A
See application file for complete search history.

(56) References Cited

U.S. PATENT DOCUMENTS

| | | | | |
|---|---|---|---|---|
| 4,061,118 | A | 12/1977 | Kiyota | |
| 6,263,841 | B1 | 7/2001 | Beveridge | |
| 6,484,695 | B1 * | 11/2002 | Cobb, Jr. | 123/438 |
| 6,601,550 | B2 * | 8/2003 | Geyer et al. | 123/73 PP |
| 2001/0032601 | A1 * | 10/2001 | Galka et al. | 123/73 A |
| 2002/0124817 | A1 * | 9/2002 | Abei | 123/73 C |
| 2004/0040522 | A1 | 3/2004 | Mavinahally et al. | |

FOREIGN PATENT DOCUMENTS

| | | | |
|---|---|---|---|
| EP | 1705350 | A2 | 9/2006 |
| WO | 0011334 | | 3/2000 |
| WO | 2006094603 | A1 | 9/2006 |

* cited by examiner

*Primary Examiner* — M. McMahon
(74) *Attorney, Agent, or Firm* — Browdy & Neimark, PLLC

(57) ABSTRACT

A fuel injection system for a two-stroke internal combustion engine (1), elastically housed internally of a chamber, comprises a carburetor (30) to which are associated an induction port (9) for an air/fuel mixture and a fuel supply conduit (10) intercepted by means for metering housed in a recess (16) communicating with a second aperture (15) located above the induction port (9), which is in turn connected by an accumulation conduit (12) to a first aperture (14) located below the induction port (9), the apertures (14, 15) being alternatively opened by the piston skirt (3); the accumulation conduit is entirely afforded in the cylinder body.

8 Claims, 15 Drawing Sheets

CYLINDER/CRANKCASE GROUP FOR TWO-STROKE INTERNAL COMBUSTION ENGINES PROVIDED WITH MEANS FOR SUPERCHARGING THE ENGINE

The invention relates to a fuel injection system for two-stroke internal combustion engines.

Document WO 00/11334 illustrates two-stroke internal combustion engines comprising a crankcase and a cylinder connected to the crankcase. The induction port originating from the carburettor terminates in the zone between the cylinder base and the crankcase, supplying a lean mixture, i.e. with an excess of air with respect to the stoichiometric ratio, which has the purpose of lubricating the crankcase crank mechanisms and provide comburent air. An alternative reciprocating piston is located inside the cylinder, which causes aspiration of the lean mixture into the crankcase, during the upstroke, and the transfer of the mixture into the cylinder through a transfer conduit between the crankcase and the cylinder during the downstroke. There is also an exhaust port located in front of the induction port.

An injection system is provided which comprises a fuel intake conduit which feeds an accumulation system, which accumulation system comprises an accumulation conduit which exhibits a first aperture and a second aperture communicating with the cylinder respectively below and above the induction port of the mixture into the cylinder. The piston skirt opens and closes the two apertures in succession while reciprocating in the cylinder.

Before being injected into the cylinder through the second aperture, the fuel accumulates in the accumulation conduit from where it is injected into the cylinder by means of a pressure wave generated by the explosion of the mixture in the cylinder. The pressure wave penetrates into the accumulation conduit through the second aperture and runs along it up to the first aperture which is closed by the piston skirt. From here, it runs up the conduit, entraining the fuel with it, which is thus injected into the cylinder. Usually the injection of the fuel into the cylinder occurs when the piston is at the bottom dead centre or just before it, and with the first aperture closed.

In order to inject the correct amount of fuel into the cylinder, the quantity accumulated in the accumulator must be properly metered before injection into the cylinder.

To do this, controlled metering devices are used, as for example the carburettor described in international patent WO 2006/094603.

The devices in the prior art exhibit a drawback deriving from the constructional complication of the injection system, with special reference to the fuel accumulation conduit.

In these known systems, the accumulation conduit is made at least in part externally of the cylinder body, by means of special tubes which connect up the ends of the conduits afforded in the cylinder body itself.

The aim of the present invention is to make available a cast cylinder body comprising at least the fuel accumulation conduit of the injection system.

The aim is attained by a fuel injection system for two-stroke internal combustion engines as described in claim 1.

The dependent claims delineate preferred and particularly advantageous embodiments of the invention.

The characteristics and advantages of the invention will better emerge from a reading of the following description, which is provided by way of non-limiting example, with the aid of the accompanying figures of the drawings, in which:

FIGS. 1A-1E schematically illustrate, in axial section, an engine incorporating a fuel injection system with the piston in the different operative positions it assumes during the cycle;

Figure 1A:
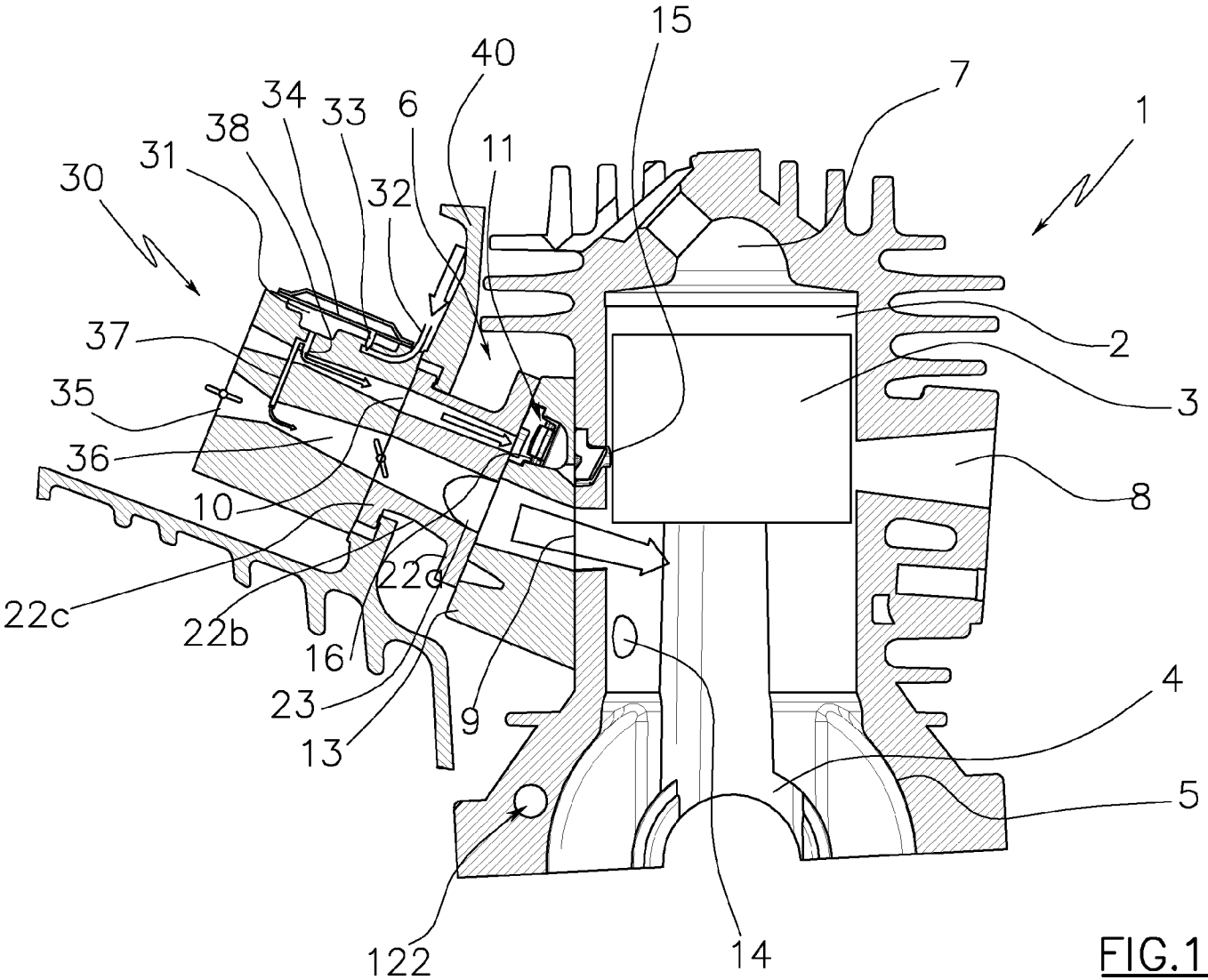
Figure 1B:
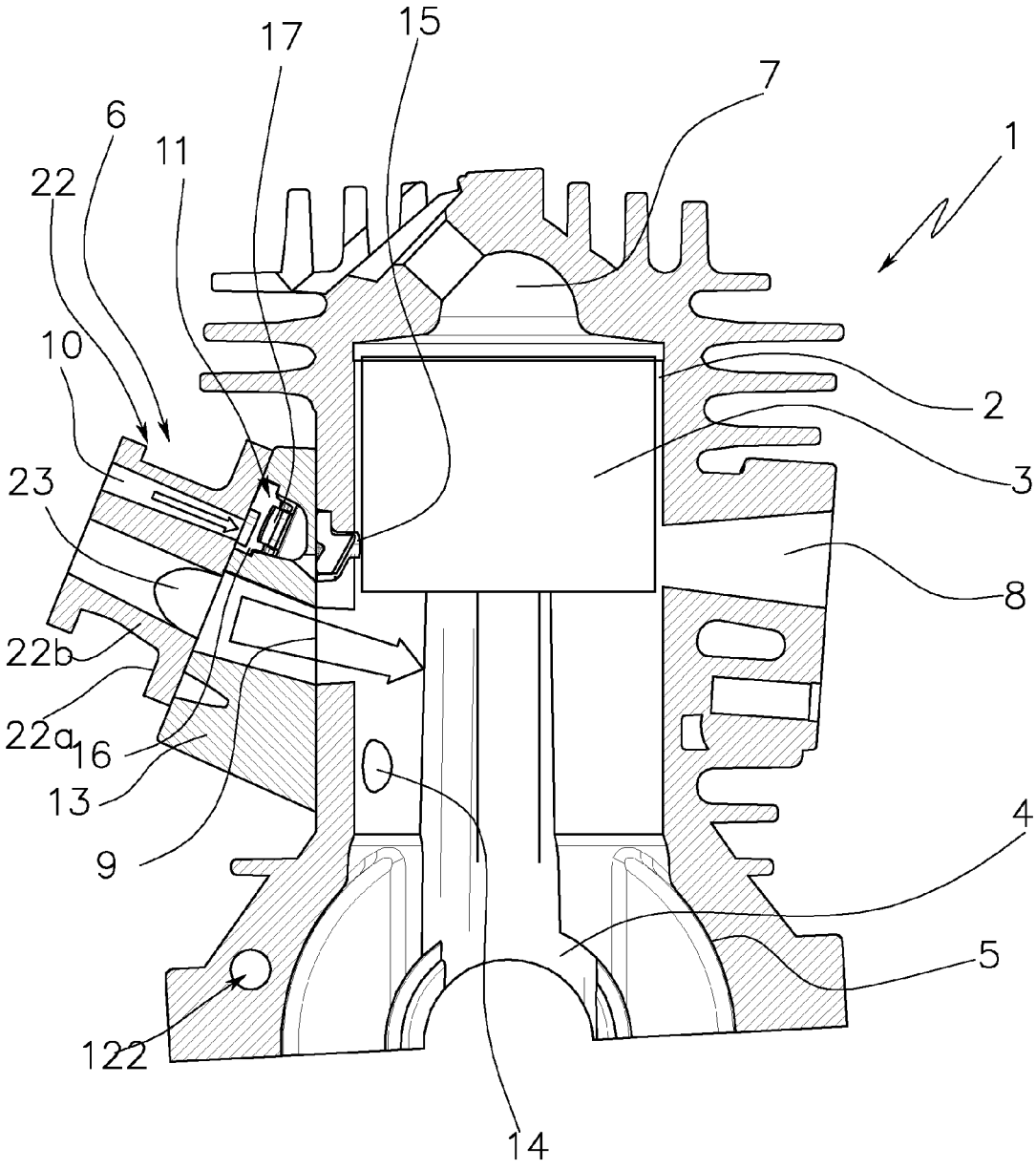
Figure 1C:
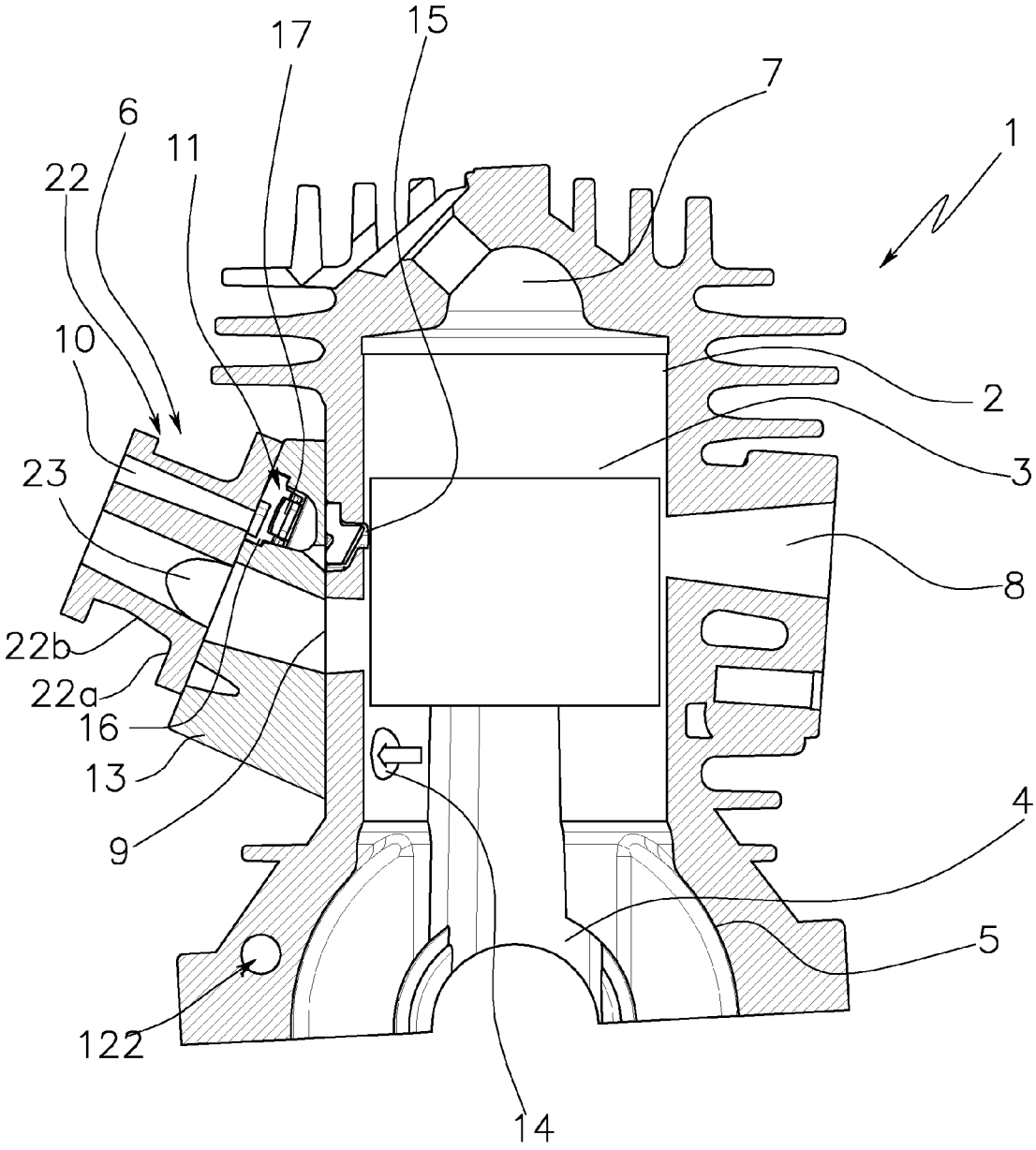

With reference to the above figures of the drawings, a fuel injection system for an internal combustion engine 1 is illustrated.

The engine 1 is a two-stroke engine comprising a cylinder 2, a piston 3, a con rod 4 joined to the crankshaft, a crankcase 5, a transfer conduit 24 (FIGS. 1D, 1E) between the crankcase 5 and the cylinder 2 and a fuel injection system 6.

The cylinder 2 exhibits a head to which a sparking plug is associated (not illustrated), while the lower end communicates freely with the crankcase 5. The combustion chamber 7 is afforded in the head. The exhaust port 8 and the induction port 9 for the air/fuel mix are located more or less at the base of the cylinder 2, and more or less opposite one another.

The air/fuel mix supplied to the crankcase 5 is, according to the invention, a weak mixture, i.e. with an excess of air with respective to the stoichiometric ratio, and as well as the comburent air-supply function, also has a lubricating function.

The mix is composed of fuel which is mixed with air in the form of tiny droplets in a carburettor 30, illustrated for the sake of simplicity only in FIG. 1.

The carburettor 30 is a diaphragm carburettor, which functions under any ratio and does not spill fuel during manoeuvres or during transport. It essentially comprises a bowl 31, which the pressurised fuel reaches via a conduit 32 intercepted by a needle valve 33 activated by a diaphragm 34, an air inlet conduit 35 which communicates with an aspiration conduit 36 associated to the inlet port 9, a first fuel conduit 37 and a second fuel conduit 38 for taking fuel from the bowl 31 respectively towards the aspiration conduit 36 and a fuel feed conduit 10 belonging to the fuel injection system 6.

Figure 9:
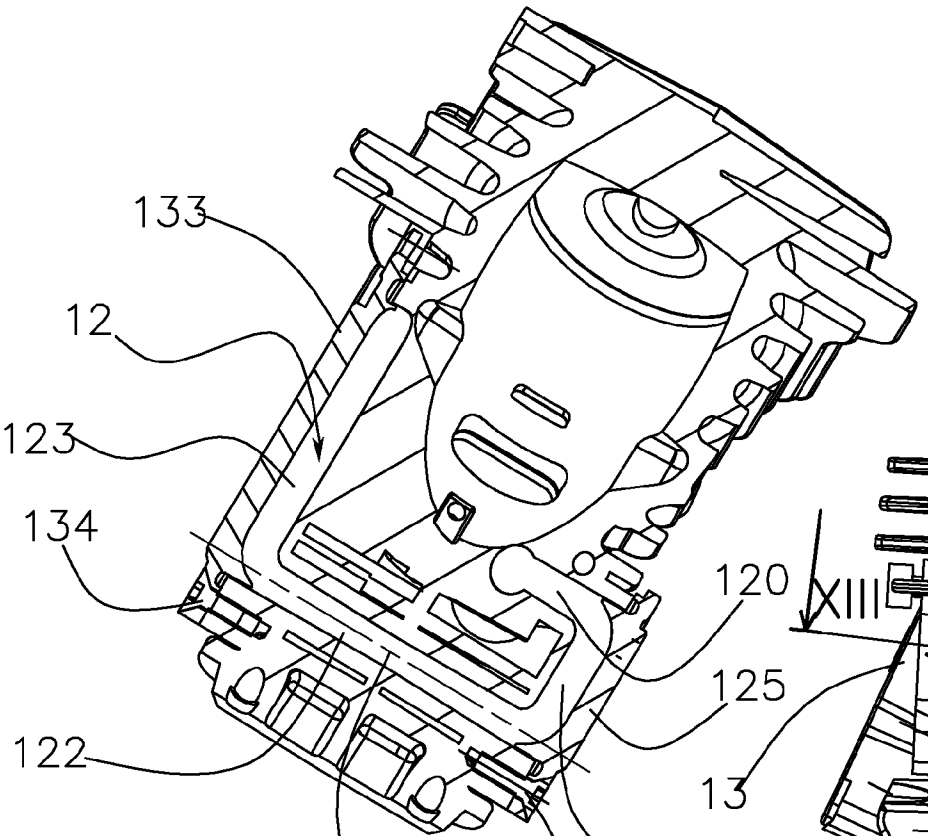
FIG. 9 is a section along line IX-IX of FIG. 8.

The fuel feed conduit 10 is intercepted by valve means 11, of which a fuller description will be provided herein below, and communicates with an accumulation conduit 12 (FIG. 9).

Figure 13:
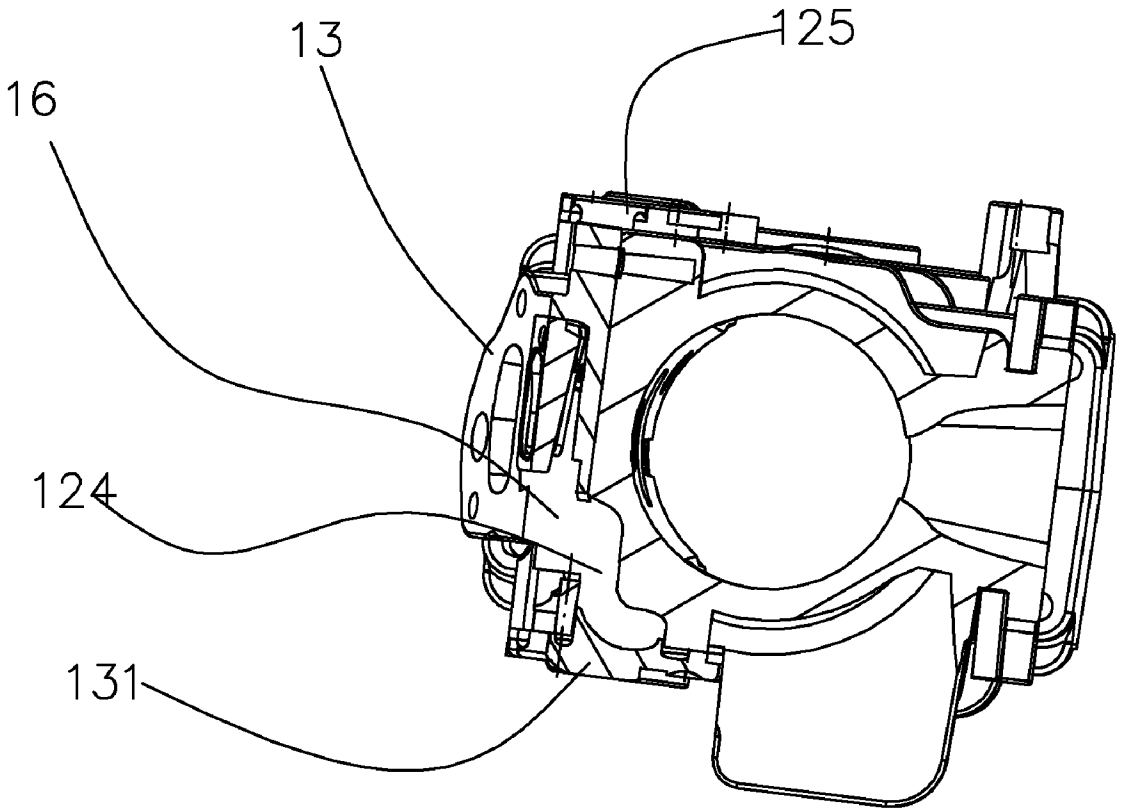
FIG. 13 is a section along line XIII-XIII of FIG. 8.

The accumulation conduit 12 is obtained by casting in the cylinder body and consists in a channel comprising a first tract 120, a second tract 121, a third tract 122, a fourth tract 123 and a fifth tract 124 (FIG. 13).

Figure 7:
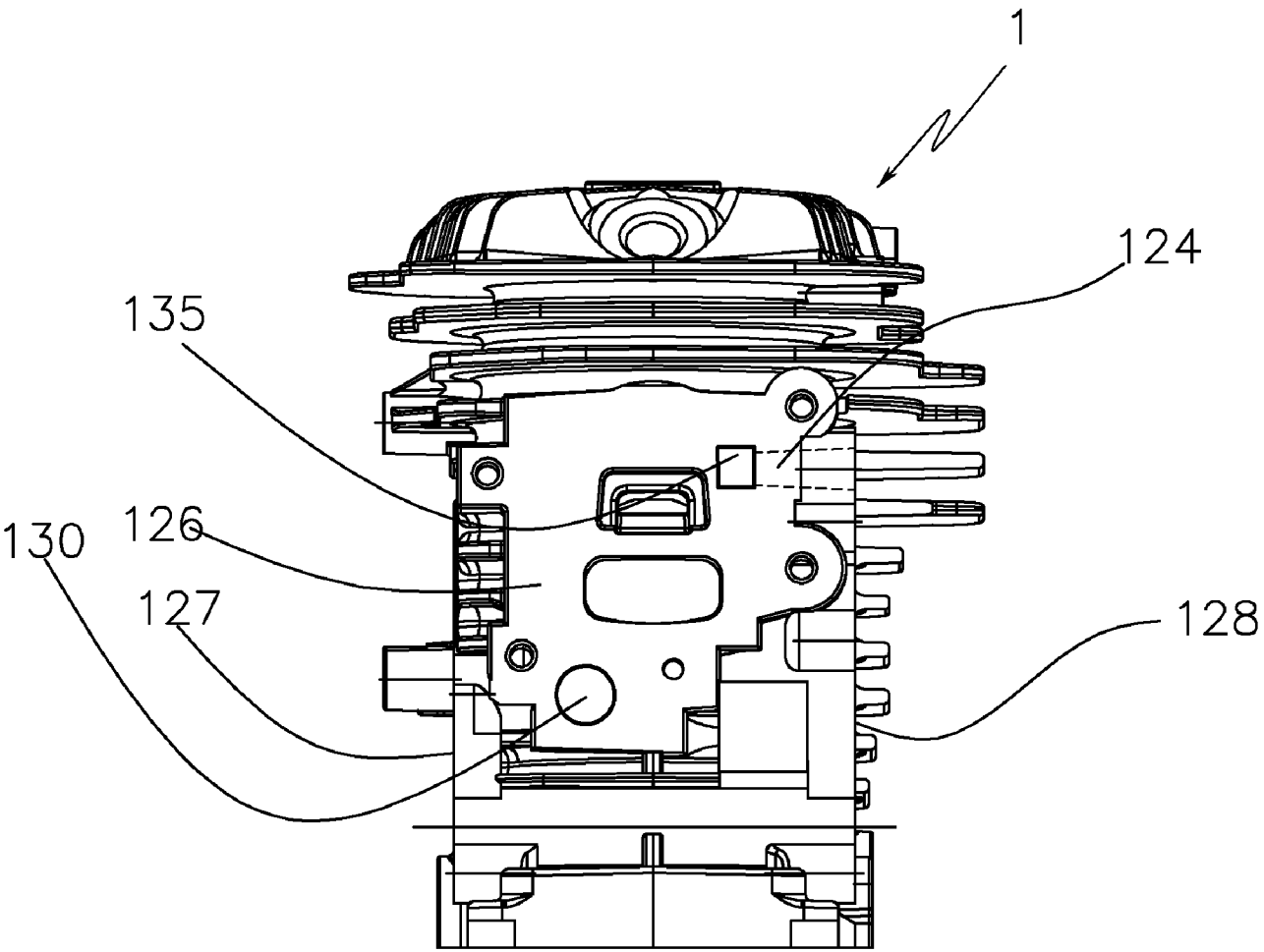
FIG. 7 is a view of the cylinder from the carburettor side without the flange.
Figure 8:
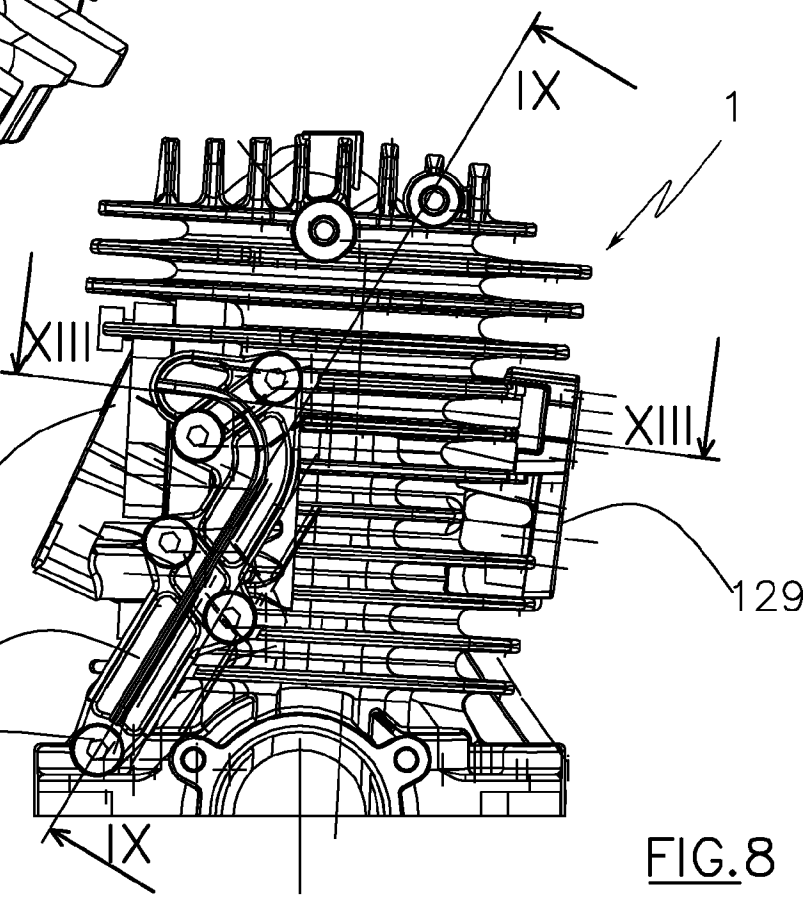
FIG. 8 is the view from the right of FIG. 4.

Flat surfaces 127, 128 are present on the external part of the cylinder (FIG. 7) lying in parallel planes and on opposite sides with respect to the axis of the cylinder, and flat surfaces 126 and 129 (FIGS. 6, 8) lying in planes which are perpendicular to the surface planes 127 and 128 and on opposite sides with respect to the cylinder axis.

Figure 6:
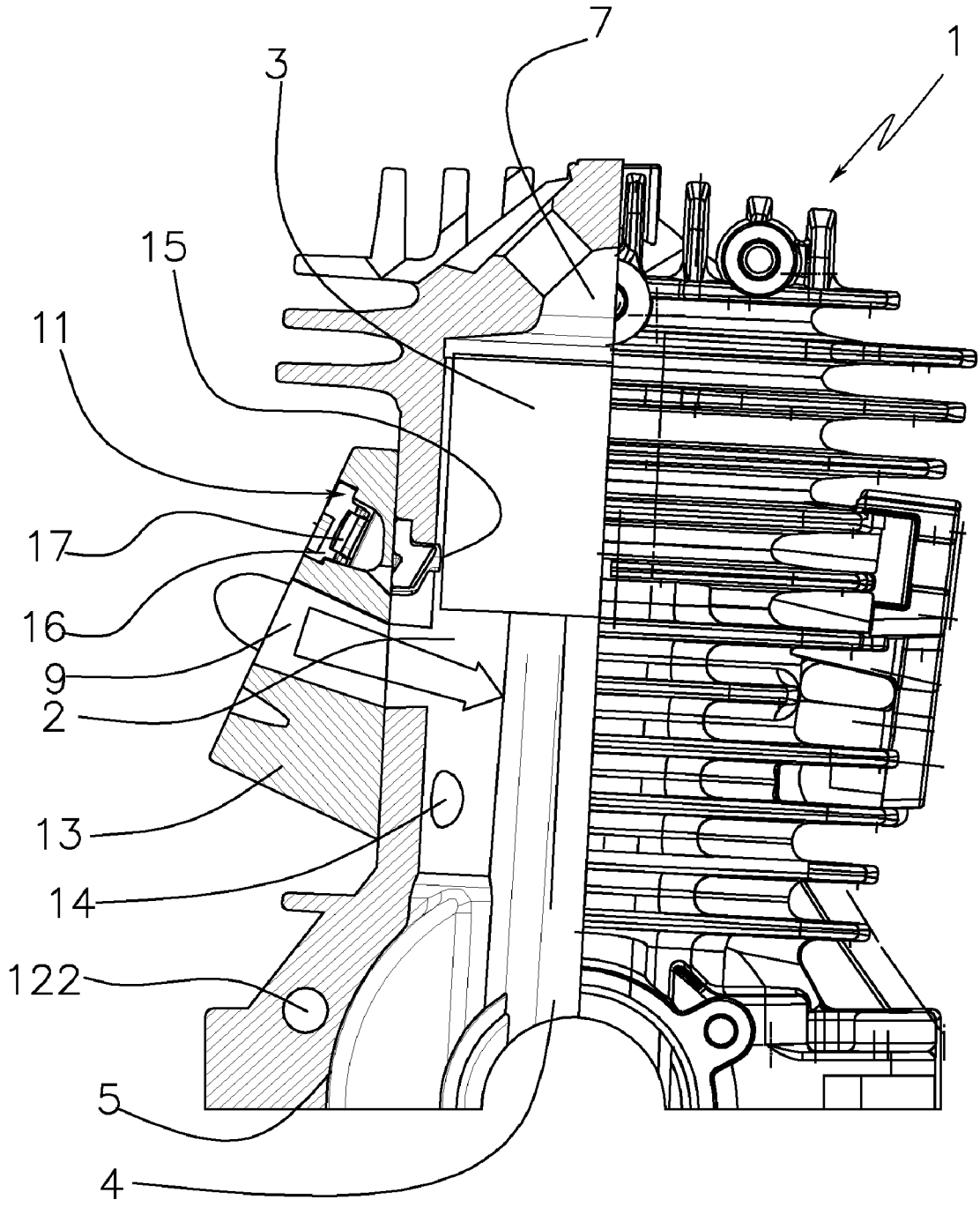
FIG. 6 is the partial section of FIG. 4 along line VI-VI.

The first tract 120 (FIG. 9) is a blind hole with an axis that is perpendicular to the surface 127 and the final part thereof intercepts the port 130 (FIG. 7) which departs from the surface 126 and terminates in a port 14 internally of the cylinder (FIG. 6).

The port 14 communicates with the crankcase 5 below the induction port 9 for the mixture.

The second tract 121 is connected to the first tract 120 and is obtained by a recess having a semicircular section afforded in the surface 127.

Figure 12:
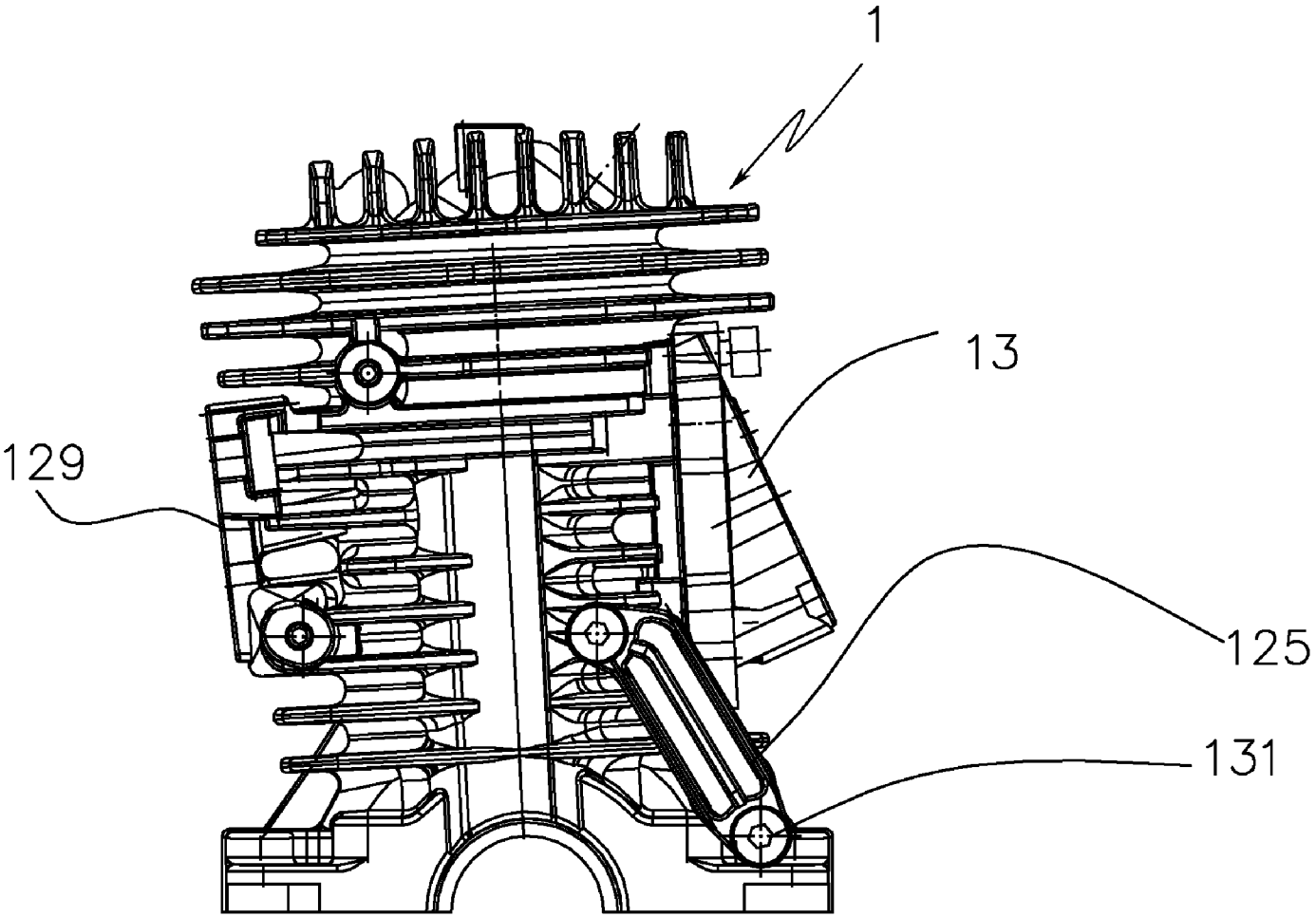
FIG. 12 is a view from the left of FIG. 4.

The tract 121 is closed by a cover 125, also having a semicircular section, by means of screws 131 such that the union of the cover with the recess creates a circular-section conduit (FIG. 12).

The third tract 122 is connected to the tract 121 and is constituted by a circular hole the axis of which 132 is perpendicular to the surfaces 127 and 128 and crosses the entire body of the cylinder (FIG. 9).

Figure 10:
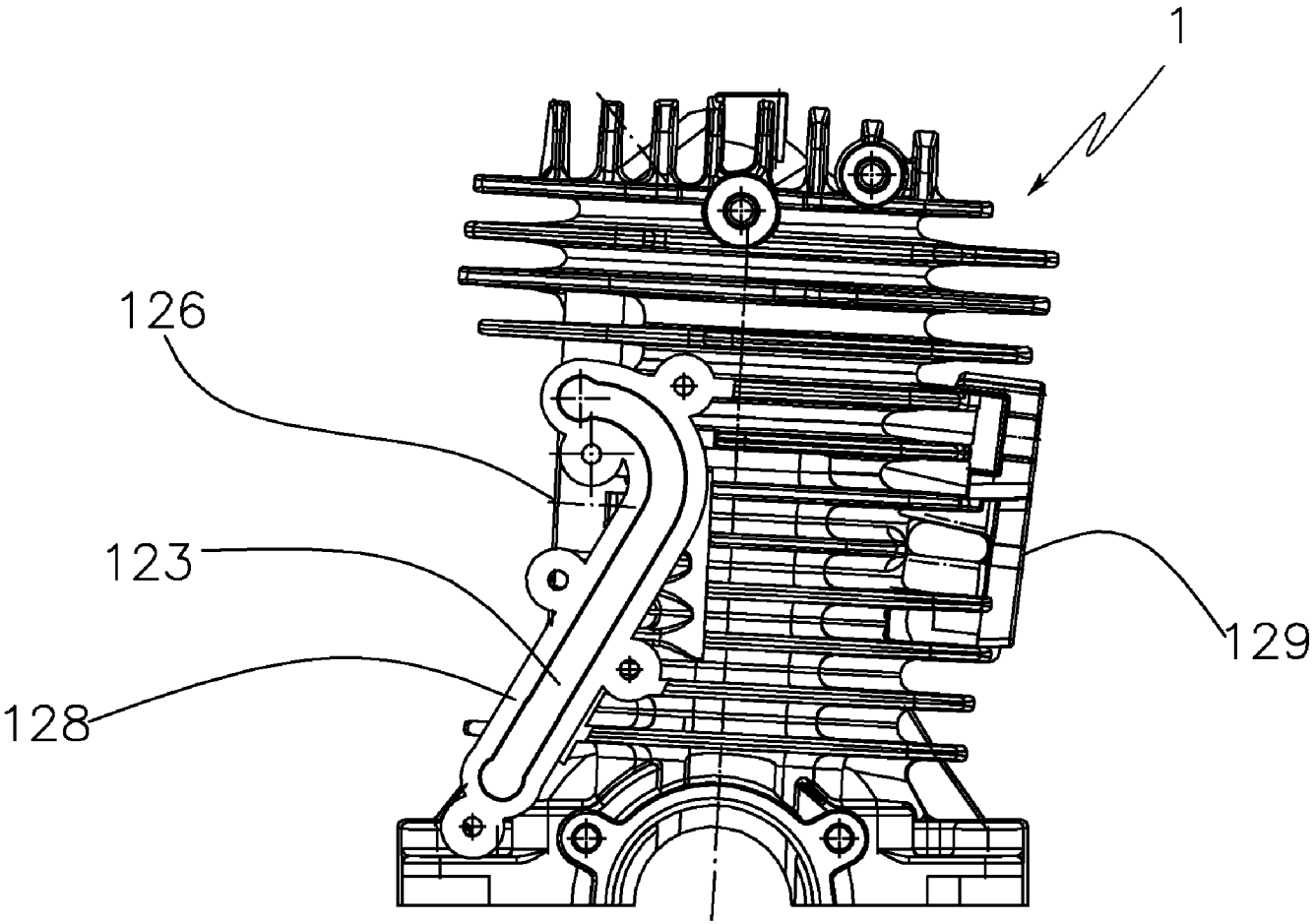
FIG. 10 is a view from the right of FIG. 7.
Figure 11:
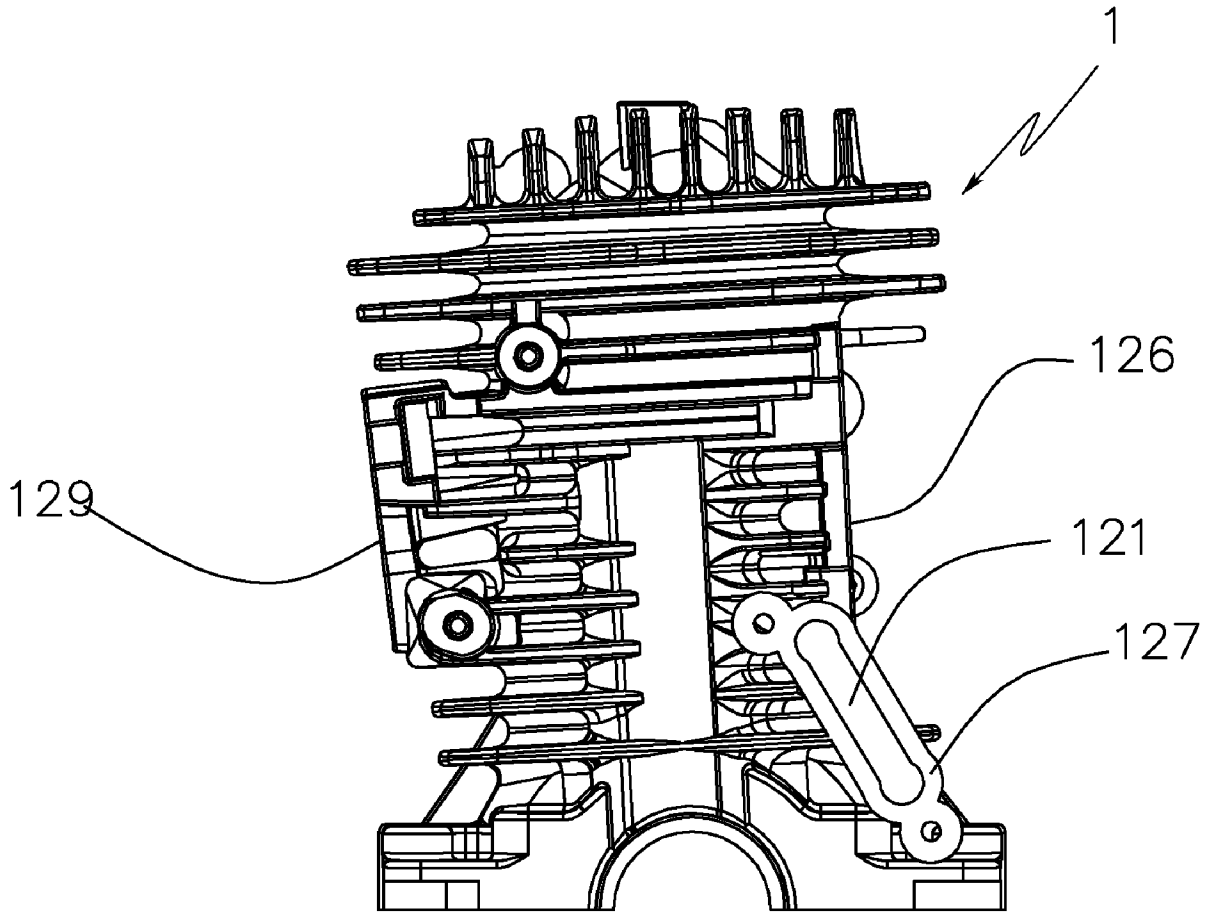
FIG. 11 is a view from the left of FIG. 7.

The fourth tract 123 is connected to the final part of the tract 122 and is obtained with a semicircular-section recess made in surface 128 (FIG. 10).

The tract 123 is closed by a cover 133, also having a semi-circular section, by means of screws 134 such that the union of the cover 133 with the recess creates a circular-section conduit.

The fifth tract 124 (FIG. 13) is a blind hole having an axis perpendicular to the surface 128 and is connected to the final part of the tract 123, and at an end thereof intercepts an aperture 135 (FIG. 7) of the surface 126.

Figure 3:
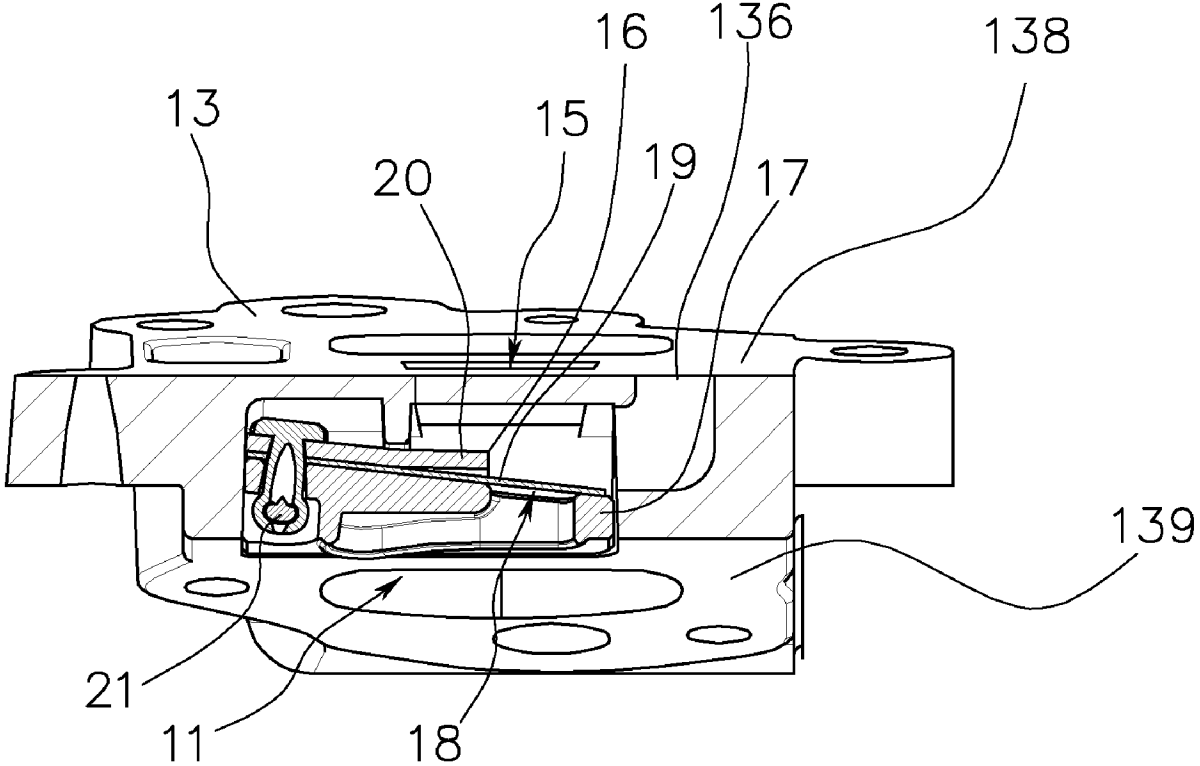
FIG. 3 shows a section view along line III-III of FIG. 2.
Figure 4:
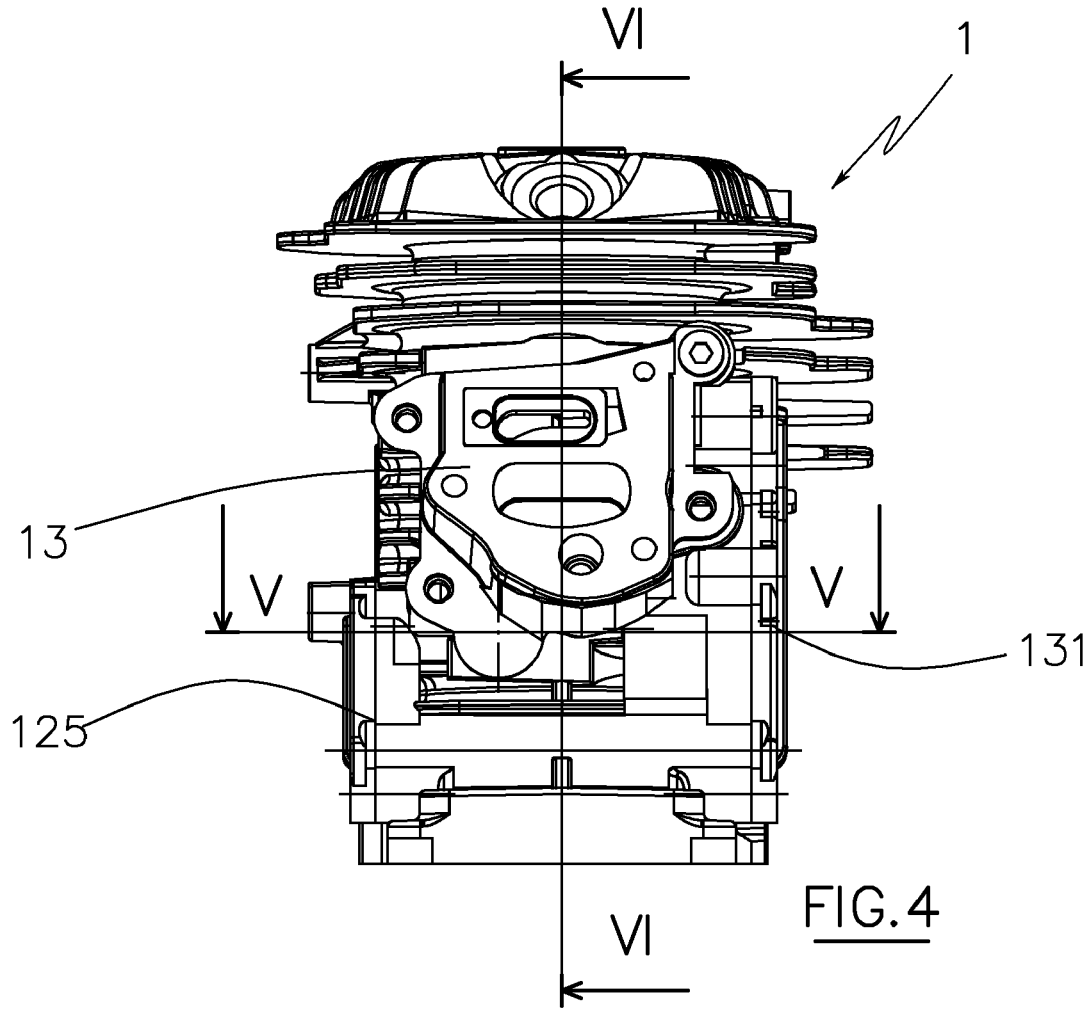
FIG. 4 is a view of the cylinder from the carburettor side with the flange.
Figure 5:
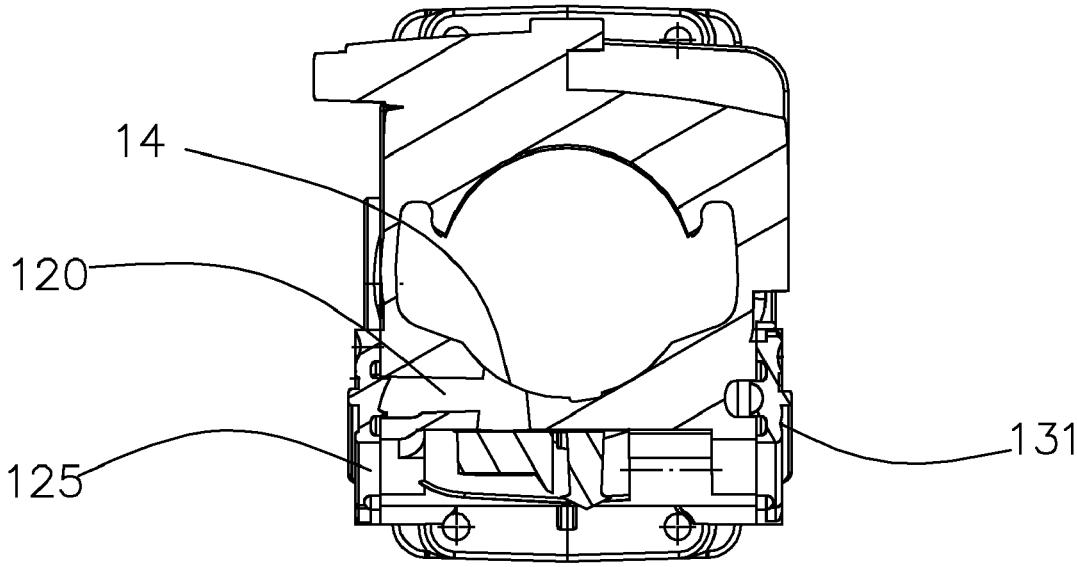
FIG. 5 is a section along line V-V of FIG. 4.

In the invention, the aperture 135 communicates with an aperture 136 of a flange 13 fixed to the engine 1 (FIG. 3).

The flange 13 exhibits two opposite planes 138 and 139, a first of which 138 is coupled to the plane 126 and a second of which 139 is fixed to the elastic manifold 22.

The aperture 136 is connected to a recess 16 which communicates with an aperture 15 which faces internally of the cylinder 2.

The apertures 14 and 15, distanced from one another, are placed below and above the mixture induction port 9.

The piston skirt 3 is conformed such as to open, in succession, the first aperture 14 and the second aperture 15 during the upstroke and vice versa during the downstroke.

The recess 16 is conformed such as snugly to receive, in proximity of the second aperture 15, the valve means 11 which intercept the fuel feed conduit 10.

Figure 1D:
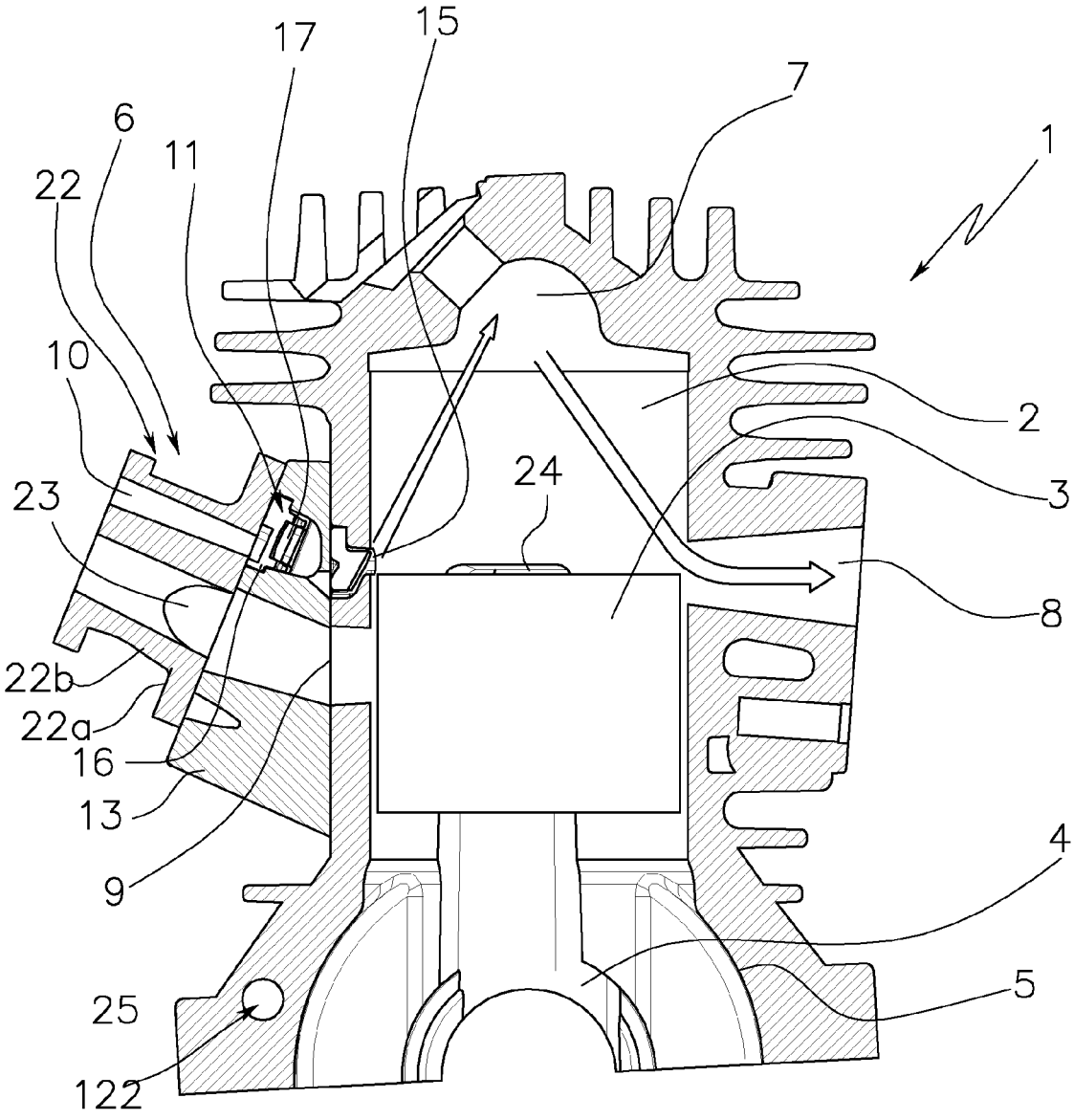
Figure 1E:
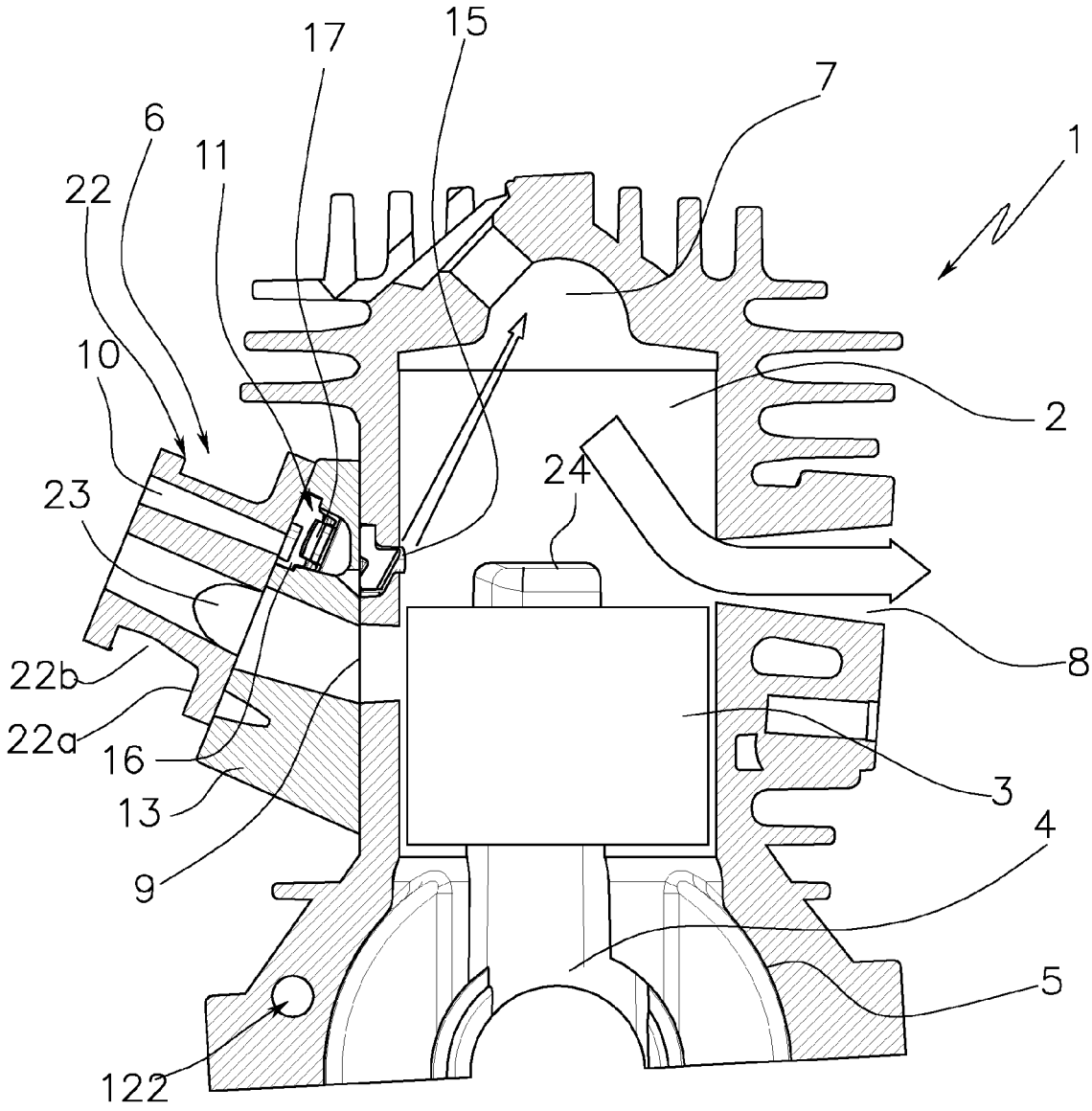
Figure 2:
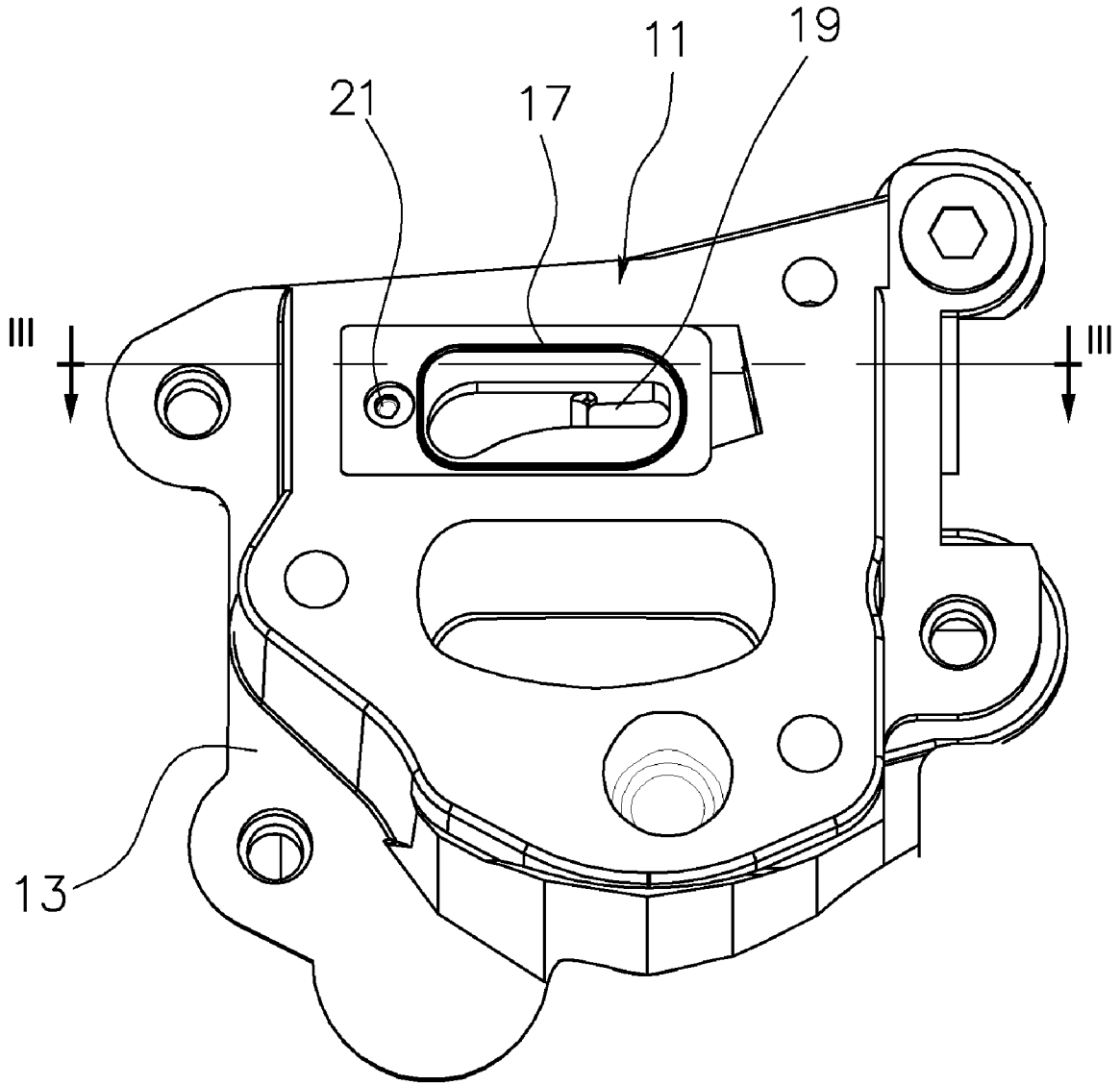
FIG. 2 shows the flange of the injection system of the present invention, carburettor side.

The insulating manifold 22 is sealedly fixed to the flange 13 and comprises a rigid base 22*a* sealedly fixed to the flange 13, an intermediate body 22*b* made of an elastically deformable synthetic material, and a flange 22*c* fixed between the carburettor 30 and the wall 40 of the engine 1 housing chamber, a part of the fuel feed conduit 10 and a channel 23 leading to the induction port 9 of the air/fuel mix being afforded in the intermediate body 22*b* (FIG. 1A).

The valve means 11 are activated to open, enabling aspiration of the fuel present in the conduit 10 into the accumulation conduit 12, thanks to a depression created in the conduit 12 through the first aperture 14.

The opening action will be more fully described herein below.

In the preferred embodiment of the present invention, the valve means 11 comprise a valve body 17 provided with a passage 18 and a flexible blade 19 which occludes the passage 18 in the direction of the conduit 10 (FIG. 3).

In the example, the flexible blade 19 is preferably made of a metal or of fibreglass and is fixed to an end of the valve body 17, lying peripherally in contact with the valve body 17.

The flexible blade 19 can, in substance, flex only on one side as the peripheral portion striking against the valve body 17 prevents the flexible blade 19 from flexing in the other direction.

In the example, the flexion is towards the inside of the accumulation conduit 12.

On the side facing the fuel feed conduit 10, the flexible blade 19 is constantly wetted by the fuel which is isolated from the accumulation conduit 12 when the blade 19 is in the closed position.

The first aperture 14 and the second aperture are in communication with one another through the accumulation conduit 12 even when the flexible blade 19 is in the closed position.

According to the present invention, the fuel in the fuel feed conduit 10, which wets the flexible blade 19, crosses the passage 18 of the valve body 17 when, on the opposite side of the flexible blade 19 to the side wetted by the fuel, a sufficient depression is created to flex the flexible blade 19, opening the passage 18 (see FIG. 3).

In substance, the opening of the valve means 11 is controlled simply by the difference in pressure exerted on the opposite sides of the flexible blade 19. Means for limiting the opening of the blade 19 are provided, such as a rigid strip 20, fixed by the rivet 21 to an end of the valve body 17 for limiting the opening angle of the blade 19 (FIG. 3).

The functioning of the invention is described with reference to figures from 1A to 1E, and comprises:

a compression phase (FIG. 1A), in which the piston rises up to its top dead centre. During the rise thereof it opens the first aperture 14 and the induction port 9 and closes the second aperture 15 and the exhaust port 8. During this phase, the pressure in the crankcase 5 falls below atmospheric pressure. Then, when the first aperture 14 is open, a depression is caused in the accumulation conduit 12. This depression causes the flexible blade 19 to open and aspirates the fuel from the conduit 10 into the accumulation conduit 12, immediately after which, and during the rise of the piston, the induction port 9 also opens, from which a new weak mix is aspirated;

a combustion phase (FIG. 1B), in which the piston 3 is close to the top dead centre, a spark in the combustion chamber 7 ignites the fuel-air mixture which is compressed above the piston 3. The pressure in the crankcase 5 and the pressure in the accumulation conduit 12 at the second aperture 15 do not change as the flexible blade 19 is closed thanks to the elastic recall helped by the combustion pressure. The combustion in the combustion chamber 7 causes an expansion of the gases which push the piston 3 downwards;

an expansion phase (FIG. 1C), in which the piston 3 performs its downstroke and occludes the second outlet aperture 15, the exhaust ports and the induction port 9, while the first inlet aperture 14 is open. The weak mix previously aspirated is compressed in the crankcase 5 and, through the first aperture 14, also in the accumulation conduit 12 where fuel is already present;

a discharge stage (FIG. 1D), in which the piston 3, continuing in its downstroke, opens the exhaust port 8 and during the descent occludes the induction port 9 and the first aperture 14, while it opens the second aperture 15; the high-pressure discharge gases, when expelled from the discharge aperture 8, transfer a part of their energy into the accumulation conduit 12 through the second aperture 15 in the form of a pressure wave; further, the mix begins transferring from the crankcase 5 to the combustion chamber 7 through the transfer conduit 24;

an injection phase (FIG. 1E), in which the piston 3 begins to rise from the bottom dead centre, closes the induction port 9 and the first aperture 14. The pressure wave trapped in the accumulation conduit 12 reaches the opposite end corresponding to the closed first aperture 14 and returns, drawing with itself the fuel accumulated in the accumulation conduit 12, which is injected at high speed into the combustion chamber 7.

When the fuel is injected into the combustion chamber 7 the pressure is close to atmospheric.

Thanks to the pressure wave which injects the fuel at high velocity, the fuel is pulverised, improving its performance; consequently the engine uses less fuel, with an accompanying reduction in pollution due to cleaning-out losses. Injection of the fuel along a desired direction can be obtained by specially conforming the second aperture 15.

As can be appreciated from what is described herein, the fuel injection system for an internal combustion engine according to the present invention enables the needs to be satisfied and the drawbacks overcome, as mentioned in the introductory part of the present description with reference to the prior art.

Obviously an expert in the sector might make numerous modifications and variants to the internal combustion engine fuel injection system in order to meet contingent and specific needs, all of which, however, fall within the sought ambit of protection of the engine as defined in the following claims.

The invention claimed is:

1. A fuel injection system comprising an accumulation conduit (12) of fuel, which accumulation conduit (12) communicates with a first aperture (14) located below an induction port (9) and with a second aperture (15), located above the induction port (9), the apertures (14, 15) being characterised in that the accumulation conduit is entirely contained in the cylinder body.

2. The system of fuel injection of claim 1, characterised in that at least a tract of the accumulation conduit comprises a portion conformed as a channel, afforded in the cylinder body, which portion is closed by an external cover having a portion which is complementary to the channel.

3. The fuel injection system of claim 1, characterised in that the accumulation conduit exhibits at least two consecutive tracts lying in adjacent planes which delimit portions of the cylinder body.

4. The fuel injection system of claim 3, characterised in that one of the adjacent planes constitutes a fixing seating of an aspiration manifold flange.

5. The fuel injection system of claim 3, characterised in that the accumulation conduit comprises a first tract which opens into a port afforded in the cylinder wall below the induction port.

6. The fuel injection system of claim 3, characterised in that the accumulation conduit comprises a final tract which opens into a cavity communicating with an inside of the cylinder through a port afforded in the cylinder wall above the induction port.

7. The fuel injection system of claim 6, characterised in that the cavity communicates with a fuel feed conduit through a metering valve.

8. The fuel injection system of claim 7, characterised in that the metering valve is a blade valve which opens only in a direction towards the inside of the cylinder.

* * * * *